US006622358B1

(12) United States Patent
Christy

(10) Patent No.: US 6,622,358 B1
(45) Date of Patent: Sep. 23, 2003

(54) LACE TIGHTENING ARTICLE

(76) Inventor: Philip Troy Christy, 52 Martin Rd., Hopewll Junction, NY (US) 12533

( * ) Notice: Subject to any disclaimer, the term of this patent is extended or adjusted under 35 U.S.C. 154(b) by 0 days.

(21) Appl. No.: 10/090,032

(22) Filed: Mar. 5, 2002

(51) Int. Cl.[7] ..... A43C 7/00
(52) U.S. Cl. ..... 24/712.9; 24/713; 36/50.1
(58) Field of Search ..... 24/712.2, 712.3, 24/712.4, 712.9, 713, 715, 715.1, 715.3, 715.6; 36/45, 50.1; 403/223; 285/235

(56) References Cited

U.S. PATENT DOCUMENTS

| | | | | | |
|---|---|---|---|---|---|
| 339,460 | A | * | 4/1886 | Pilkington | 24/15 |
| 777,563 | A | | 12/1904 | Stubbs | |
| 849,921 | A | | 4/1907 | Schelling | |
| 891,825 | A | * | 6/1908 | Dorff | 403/214 |
| 942,007 | A | * | 11/1909 | Morrill | 24/129 R |
| 1,172,954 | A | | 2/1916 | Derrenberger | |
| 1,504,043 | A | * | 8/1924 | Hidock | 24/712.4 |
| 2,308,286 | A | * | 1/1943 | Joyce | 174/87 |
| 3,074,135 | A | | 1/1963 | Brodowski | |
| 3,094,755 | A | * | 6/1963 | Casanave | 24/129 R |
| 3,321,815 | A | * | 5/1967 | Herdman | 24/712.3 |
| 3,903,574 | A | * | 9/1975 | Fraioli | 403/398 |
| 3,952,376 | A | * | 4/1976 | Ellis | 24/115 A |
| 4,059,866 | A | * | 11/1977 | Rohland | 16/108 |
| 4,247,967 | A | | 2/1981 | Swinton | |
| 4,648,159 | A | * | 3/1987 | Dougherty | 24/712.7 |
| 4,864,695 | A | | 9/1989 | Gold | |
| 5,099,552 | A | * | 3/1992 | Kimbrough | 24/715.6 |
| 5,119,539 | A | | 6/1992 | Curry | |
| 5,293,675 | A | * | 3/1994 | Shai | 24/712.1 |
| 5,388,315 | A | * | 2/1995 | Jones | 24/712.1 |
| 5,535,531 | A | * | 7/1996 | Karabed et al. | 36/50.1 |
| 5,613,283 | A | | 3/1997 | Yusfan | |
| 5,619,778 | A | * | 4/1997 | Sloot | 24/715.4 |
| 5,630,257 | A | * | 5/1997 | Brody et al. | 24/300 |
| 5,638,589 | A | * | 6/1997 | Phillips | 24/715.4 |
| 5,683,199 | A | * | 11/1997 | Tehan | 403/314 |
| 6,055,714 | A | * | 5/2000 | Sproul | 29/402.21 |
| 6,158,095 | A | * | 12/2000 | Lassiter | 24/339 |
| 6,192,559 | B1 | | 2/2001 | Munsell, Jr. | |
| 6,381,816 | B1 | * | 5/2002 | Lai et al. | 24/712.9 |
| 6,470,542 | B1 | * | 10/2002 | Giannini | 24/712.1 |

FOREIGN PATENT DOCUMENTS

| | | | |
|---|---|---|---|
| JP | 05-049506 | * | 3/1993 |

* cited by examiner

*Primary Examiner*—Anthony Knight
*Assistant Examiner*—André L. Jackson
(74) *Attorney, Agent, or Firm*—Joseph L. Spiegel

(57) ABSTRACT

An article for tightening together the ends of a lace includes a lace end receiving device having a pair of flexible, tubular members joined together lengthwise, each member including a lengthwise retaining passage therein. The end of the lace is received within, looped through and held within the tubular members of the lace end receiving device. By employing two lace end receiving devices, one at each end of the lace, the devices may be tied together, whereby the lace is tightened without the lace itself touching.

4 Claims, 1 Drawing Sheet

LACE TIGHTENING ARTICLE

BACKGROUND OF THE INVENTION

1. Field of the Invention

This invention relates to an article for tightening together the ends of laces. While not so limited, the article is useful in tightening together the the ends of shoe laces on a shoe.

2. Description of the Prior Art

Laces, particularly shoe laces, require tying and untying each time used, may become unlaced without warning and therefore become hazardous, and fray and break due to repetitive tying and knotting.

Additionally, lacing and unlacing is beyond the ability of some users, for example, young children and individuals with certain disabilities such as arthritis.

The prior art has been directed to a solution to one or more of the problems posed, with varying degrees of success.

Stubbs, U.S. Pat. No. 777,563, uses two cylindrical members placed upon the sides of the upper portion of the shoe through which the ends of the shoe lace are passed and then tied.

Schelling, U.S. Pat. No. 849,921, discloses a fastener for a shoe string that utilizes flexible tubular portions.

In Derrenberger, U.S. Pat. No. 1,172,954, the ends of a lace are passed through a fastener comprising hollow, truncated cone-shaped ferrules.

Various lace fastening devices are shown in the following U.S. Patents:

Price, U.S. Pat. No. 2,636 237; Brodowski, U.S. Pat. No. 3,074,135; Curry, U.S. Pat. No. 5,119,539;

Yusafan, U.S. Pat. No. 5,613,283; and, Munsell, Jr., U.S. Pat. No. 6,192,559 B1.

Swinton, U.S. Pat. No. 4,247,967, attaches hook and pile straps along the shoe lace.

Gold, U.S. Pat. No. 4,864,695, discloses a closure mechanism for a glove utilizing a channel member with draw string arrangement.

SUMMARY OF THE INVENTION

Accordingly, a primary object of this invention is the tightening together of the ends of a lace without the laces actually touching. Another object is simplifying the tying of laces for children. These and other objects are accomplished in accordance with the teachings of the present invention, one illustrative embodiment of which comprises an article for tightening together the ends of laces. The article includes a lace end receiving device having a pair of tubular members joined together lengthwise, each member including a lengthwise retaining passage therein. The end of a lace is received within, looped through and held within the tubular members of the lace end receiving device. By employing two lace end receiving devices, one at opposite ends of the lace, the devices may be tied together, whereby the lace is tightened without the laces actually touching.

BRIEF DESCRIPTION OF THE DRAWING

Other objects features and advantages of the invention will be apparent from the following detailed description and accompanying drawing, wherein.

DETAILED DESCRIPTION

Figure 1:
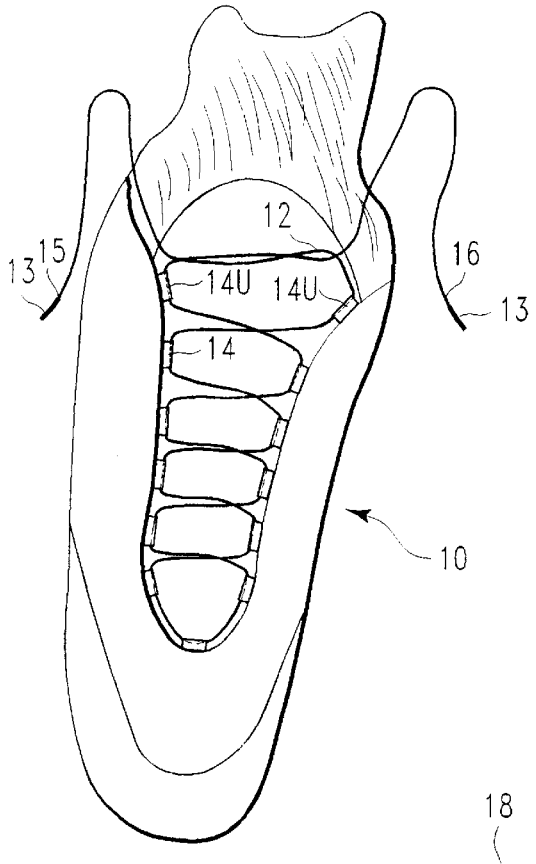
FIG. 1 is a perspective view of a shoe with lace inserted therein.
Figure 2:
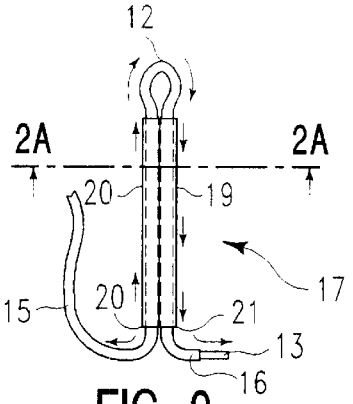
FIG. 2 is a side view illustrating the step of inserting one end of a lace in a lace end receiving device.
Figure 2A:
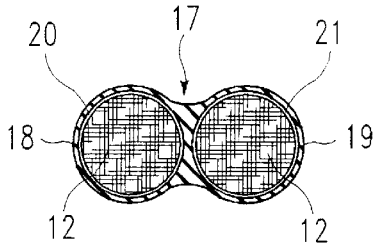
FIG. 2A is an enlarged, cross sectional view taken along the line A—A in FIG. 2.
Figure 2B:
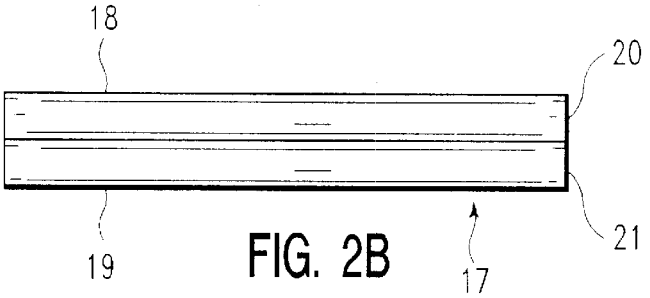
FIG. 2B is a top view of a lace receiving device.
Figure 3:
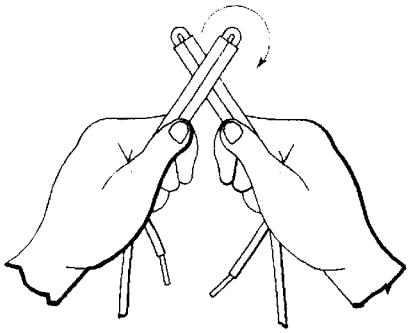
FIG. 3 is a fragmentary, perspective view illustrating the step of tying together lace end receiving devices on the opposite ends of a lace; and, FIG. 4 is a perspective view of a shoe illustrating the present invention with lace end devices tied together for tightening the shoe lace on the shoe.
Figure 4:
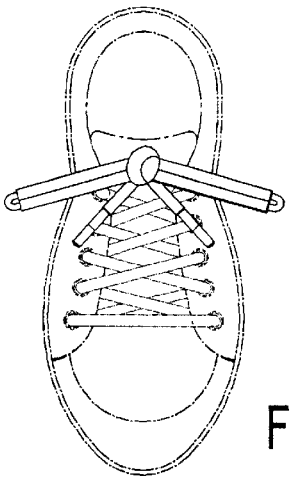

A shoe 10 is shown in FIG. 1 with a lace 12 having tips 13, threaded through a series of holes or loops 14. The lace 12 is typically of cloth, leather or plastic. A first 15 and second 16 end of the shoe lace 12 extend through the top holes or loops 14U. In FIG. 2, the first end 15 of the shoe lace 12 is shown looped through a first lace end receiving device 17. Referring to FIGS. 2, 2A and 2B, the device is seen as having a pair of tubular members 18, 19 joined together lengthwise, each member including a lengthwise passage 20, 21 extending therethrough. The lace 12 is looped through the device 17 by pushing it up through the first passage 20 and down the second passage 21. The same procedure is followed with the opposite end 16 of the lace 14. Each device is typically 3 inches long with passages of ⅜ inch diameter and made as a single piece from non-toxic, flexible plastic. The plastic is such as to retain the lace within the passages without slippage and when tied together, to be described hereafter, to remain tied. The device 17 can be made available in a variety of colors. In FIG. 3, with the second or opposite end of the lace looped through a second device, and the proximal ends of the devices preferably close to or against the top holes 14U in the shoe 11, the devices 17 are twisted, pulled and tied. FIG. 4 shows the devices 17 tied together, thereby tightening the shoe laces on the shoe. There is no requirement to attach anything to the shoes or modifying the shoes themselves in any way. It is not necessary for the lace to touch itself. Fraying of the lace is minimal since there is no knotting of the lace or rubbing between parts of a lace. The laces can not go back into the lace holes. The laces do not come loose thus avoiding tripping from a loose lace. It is easier for a child to tie this than tying a lace and is a teaching tool for when a child is able to tie a lace alone. Older persons will find it easier to use than lacing one's shoes. The invention may also be used with laces for other types of footwear, clothing, packaging and containers.

It shouls be obvious that changes, additions and omiddions may be made in the details and arrangement of parts without departing from the spirit and scope of the invention as hereinafter claimed.

What is claimed is:

1. An article for tightening together opposite end portions of a shoe lace on a shoe comprising: a first lace end portion receiving device including; a first elongated tubular body portion of flexible material, a pair of first elongated, flexible tubular members forming the first elongated body portion, each of said first elongated tubular members including a lengthwise retaining passage therein, the first elongated tubular members receiving a loop end portion of one end portion of the shoe lace, said one end portion of said shoe lace extending in one direction through the passage in one of the first elongated tubular members and in the opposite direction through the passage in the other first elongated tubular member, thereby holding said one end portion of the shoe lace; a second shoe lace end portion receiving device including; a second elongated tubular body portion, a pair of second, flexible, tubular members forming the second elongated body portion, each of the second tubular members including a lengthwise retaining passage therein, the second elongated tubular members receiving a looped end portion of the other end portion of the shoe lace, said other end portion of the shoe lace extending in one direction through the passage in in one of the second elongated tubular members and in the opposite direction through the passage in the other second elongated tubular member, thereby holding said other end portion of the shoe lace, said first and second shoe lace end portions receiving devices being tied together, whereby the shoe lace is tightened without the opposite end portions of the shoe lace touching, thereby preventing fraying of the opposite end portions of the shoe lace.

2. The article according to claim 1 wherein the first pair and second pair of tubular members are, respectively, joined together lengthwise.

3. An article for tightening together opposite end portions of a lace comprising: a first lace end portion receiving device including; a first elongated tubular body portion of flexible material, a pair of first elongated, flexible tubular members forming the first elongated body portion, each of said first elongated tubular members including a lengthwise retaining passage therein, the first elongated tubular members receiving a loop end portion of one end portion of the lace, said one end portion of said lace extending in one direction through the passage in one of the first elongated tubular members and in the opposite direction through the passage in the other first elongated tubular member, thereby holding said one end portion of the lace; a second lace end portion receiving device including; a second elongated tubular body portion, a pair of second, flexible, tubular members forming the second elongated body portion, each of the second tubular members including a lengthwise retaining passage therein, the second elongated tubular members receiving a looped end portion of the other end portion of the lace, said other end portion of the lace extending in one direction through the passage in one of the second elongated tubular members and in the opposite direction through the passage in the other second elongated tubular member, thereby holding said other end portion of the lace, said first and second lace end portions receiving devices being tied together, whereby the lace is tightened without the opposite end portions of the lace touching, thereby preventing fraying of the opposite end portions of the lace.

4. The article according to claim 3 wherein the first pair and second pair of tubular members are, respectively, joined together lengthwise.

* * * * *